US007540577B2

(12) United States Patent
Netzer

(10) Patent No.: US 7,540,577 B2
(45) Date of Patent: Jun. 2, 2009

(54) DRAWER WITH AT LEAST ONE WOODEN DRAWER SIDE WALL

(75) Inventor: Emanuel Netzer, Höchst (AT)

(73) Assignee: Julius Blum GmbH, Hochst (AT)

( * ) Notice: Subject to any disclaimer, the term of this patent is extended or adjusted under 35 U.S.C. 154(b) by 19 days.

(21) Appl. No.: 11/724,304

(22) Filed: Mar. 15, 2007

(65) Prior Publication Data

US 2007/0228906 A1 Oct. 4, 2007

(30) Foreign Application Priority Data

Mar. 28, 2006 (AT) ..... A 523/2006

(51) Int. Cl.
*A47B 88/00* (2006.01)

(52) U.S. Cl. ..... 312/348.4

(58) Field of Classification Search ..... 312/330.1, 312/348.1, 348.2, 348.4, 263, 265.5, 265.6; 403/231, 321, 322.1, 322.4, 381, 382, 409.1
See application file for complete search history.

(56) References Cited

U.S. PATENT DOCUMENTS 3,479,070 A 11/1969 Marateck et al.
5,348,386 A * 9/1994 Grass ..... 312/348.2
5,375,923 A 12/1994 Hall et al.
5,641,240 A * 6/1997 Grieser et al. ..... 403/403
5,664,857 A * 9/1997 Lautenschlager et al. 312/348.4
5,860,718 A * 1/1999 Brustle ..... 312/348.2

FOREIGN PATENT DOCUMENTS

| | | |
|---|---|---|
| AT | 368 608 | 10/1982 |
| DE | 196 48 400 | 6/1998 |
| EP | 0 740 917 | 11/1996 |
| JP | 6-169822 | 6/1994 |

* cited by examiner

*Primary Examiner*—James O Hansen
(74) *Attorney, Agent, or Firm*—Wenderoth, Lind & Ponack, L.L.P.

(57) ABSTRACT

A drawer has at least one wooden side wall and a receiving part for detachable fastening of a front panel. The receiving part is arranged in a recess formed or arranged in the wooden drawer side wall. The recess has a base closed towards the interior of the drawer or towards the exterior of the drawer. The receiving part includes a fastening device for detachable connection of the receiving part in the recess, whereby the fastening device is friction locked and/or positively held in the recess and wherein the fastening device rests on the wall area of the recess.

16 Claims, 6 Drawing Sheets

DRAWER WITH AT LEAST ONE WOODEN DRAWER SIDE WALL

BACKGROUND OF THE INVENTION

The present invention relates to a drawer having at least one wooden drawer side wall with a receiving part for preferably detachably fastening a front panel. The receiving part is arranged in a recess formed or arranged in the wooden drawer side wall, and the recess has a base closed towards the interior of the drawer or towards the exterior of the drawer.

The invention further concerns a receiving part for fastening a front panel of a drawer to a wooden drawer side wall.

According to the state of the art, numerous designs are known for fastening a front panel or a front wall to drawer side walls (panels). One example of a device for fastening the front panel of a drawer to double-walled hollow frame systems is described in EP 0 740 917 B1. In high quality and exclusive furniture, the individual drawer side parts (especially the drawer side walls) are, however, often made from wood, as these solid wood components guarantee a long life and lasting value of the drawer. The fitting for the fastening of the front panel is thereby, for example, fixed on the inside of the wooden drawer side wall, which has a negative effect on the storage space for objects in the drawer and also fails to satisfy the increasing demand for visually attractive design.

It is therefore an object of the present invention to propose a drawer of the aforementioned type which is distinguished by an improved attachment of the receiving part for the preferably detachable fastening of a front panel to the wooden drawer side wall (side panel).

SUMMARY OF THE INVENTION

The above object is achieved according to the invention in an advantageous embodiment in that the receiving part comprises a fastening device for the preferably detachable connection of the receiving part in a recess. The fastening device is friction-locked and/or positively held in the recess, and the fastening device rests on the wall area of the recess.

In this way, the user is confronted, upon looking into the interior of the drawer, by an intact wooden drawer side wall, which is free from openings and is visually attractive in design. However, if the recess has a closed base side wall towards the exterior of the drawer, then the outside of the drawer side wall is uninterrupted and has no externally visible fitting parts. The receiving part can be fixed in the recess by its fastening device—without the necessity for additional retaining elements. The receiving part is thereby fixable in the recess before the front panel is installed.

For example, provision can thereby be made that the fastening device has at least one tab which can be pressed against the wall area of the recess. Advantageously, the tab can be resilient, acted on by a spring device or bendable such that it produces a friction locked connection between the receiving part and the recess in the drawer side wall.

In one preferred embodiment of the invention, the recess can be designed such that the receiving part can be inserted into the wooden drawer side wall from the side. This enables simple assembly or disassembly, and easy access to the retaining and adjustment devices of the receiving part used.

Advantageously, provision is made that the base side wall of the recess and the drawer side panel are made unitary from a single piece. In this connection, the embodiment can be made such that the recess is milled out of the drawer side wall. Milling the recess enables the drawer side wall to be simply and automatically produced, while the contours of the recess are essentially adapted to the shape of the receiving part.

A further advantageous embodiment of the invention is produced by the fact that the receiving part advantageously lies completely behind the frontal end wall of the wooden drawer side panel and within the outer wall of the drawer side wall. This enables an advantageous connection option with a retaining element assigned to the front panel Furthermore, the receiving part does not project out of the recess, but ends at least flush with the drawer side wall. To cover the receiving part on the outer or inner side of the drawer side wall, a cover may advantageously be attached.

In one preferred embodiment of the invention, the receiving part can be detachably connected with a—preferably pre-mounted—retaining element assigned to the front panel. In this connection, reference is made to EP 0 740 917 B1 of the applicant, which describes such a connection option between a receiving part assigned to the drawer side wall and a retaining element assigned to the front panel, which are drawn towards each other by a rocking lever and finally locks together. In this embodiment, the retaining element can be fastened to the back side of the front panel such that it projects laterally and is advantageously drawn by a latch device of the receiving part to the frontal end of the drawer side wall. In one embodiment, the latch device comprises a catch part, preferably a rocking lever, which, when the retaining element is pushed in, automatically locks with the latter due to spring action. To release the latch device, provision is advantageously made that the catch part has a receiving portion for a tool, preferably a screwdriver, with which the catch part can be moved out of the locked position, thereby releasing the retaining element. One advantage of the invention also lies in the fact that the fitting shown in EP 0 740 917 B1 can also be used, with minor alterations, to fasten the front panel on wooden drawer side walls, so that the same front parts can be used for two different drawer systems.

The inventive receiving part for fastening a front panel of a drawer to at least one wooden drawer side panel is characterised by the fact that the receiving part has a fastening device for fixing the receiving part in a recess formed on the wooden drawer side wall. The design of this can be such that the fastening device has at least one bendable tab, which can be brought to rest on the wall area of the recess and thereby fixes the receiving part in the recess in its relative position.

BRIEF DESCRIPTION OF THE DRAWINGS

Further details and advantages of the present invention will be explained in more detail with the aid of the description of the figures, making reference to the drawings, which show.

DETAILED DESCRIPTION OF THE PRESENT INVENTION

Figure 1:
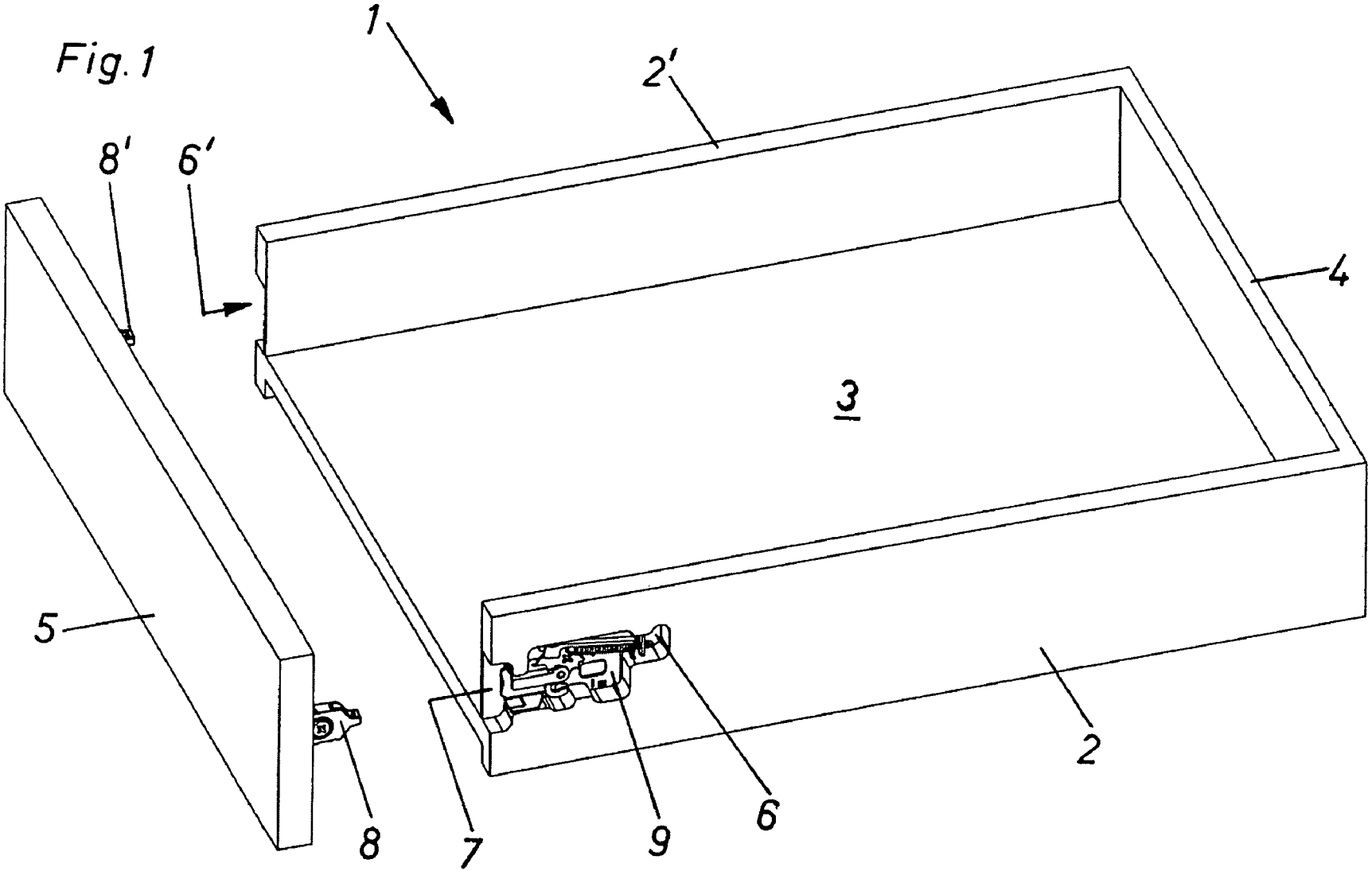
FIG. 1 a perspective view of a drawer with a receiving part inserted into the drawer side panel for the detachable fastening of a front panel, FIG. 2 an enlarged detail view of the drawer with inserted receiving part and locked retaining element, FIG. 3 an exploded view of the components used, FIGS. 4*a*-4*c* various views of the receiving part inserted in the recess in the drawer side wall, FIGS. 5*a*, 5*b* a perspective rear view and a sectional side view of the drawer with mounted front panel, and FIGS. 6*a*, 6*b* sectional views of a wooden drawer and a double walled hollow frame system.

FIG. 1 shows a perspective view of a drawer 1 which has at least one wooden drawer side wall (panel) 2, 2'. The drawer 1 includes, in a way which is known per se, a drawer base 3, a rear panel 4, and a front panel 5 to be fastened to the drawer side panels 2 and 2'. In the front end area of the drawer side panel 2, a recess 6 is formed with a base side wall 7 which is closed towards the inner side of the drawer, and the recess is preferably milled out of the solid wood of the drawer side panel 2. The contours of the recess 6 are essentially adapted to the shape of a receiving part 9, with the receiving part 9 being arranged within the recess 6. The receiving part 9 is preferably arranged completely behind the front wall of the wooden drawer side panel 2 and within the outer wall of the drawer side panel 2. On the back side of the front panel 5, a retaining element 8 is pre-mounted. In the mounted position, the retaining element 8 projects laterally and is releasably connectable, preferably lockably, with the attached receiving part 9. Such a receiving part 9 can be arranged on only one drawer side panel 2 or on both drawer side panels 2 and 2', while in similar fashion a retaining element 8' can be connected with a receiving part 9 inserted in the recess 6'.

Figure 2:
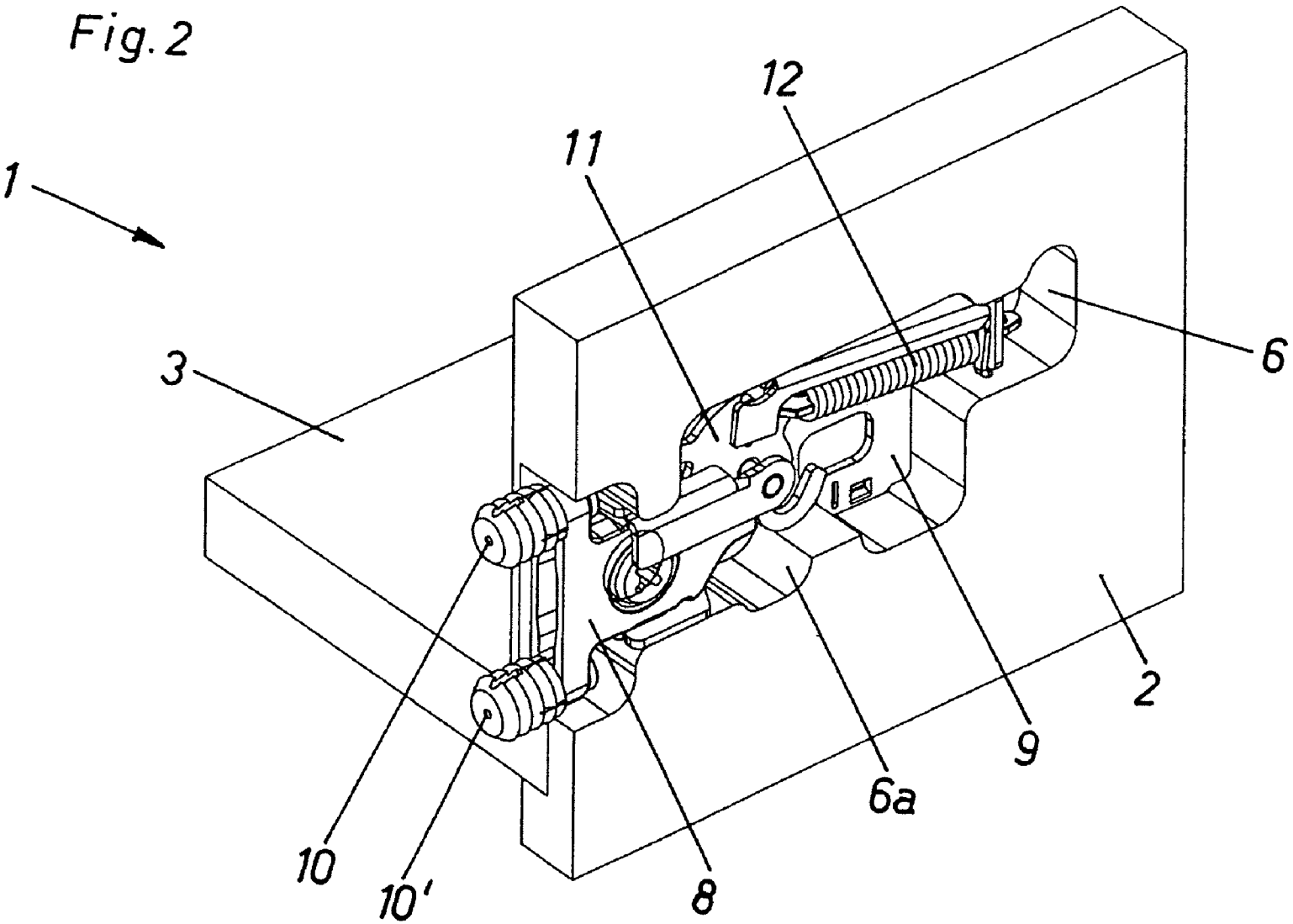

FIG. 2 shows an enlarged detail view of the drawer 1, in which the receiving part 9 is inserted in the milled-out recess 6, and the retaining element 8 of the front panel 5 (not shown) is connected with the receiving part 9, preferably latched by means of the catch device 11 in the form of a rocking lever. When the retaining element 8 is pushed in, self-locking occurs due to the effect of the spring 12. The retaining element 8 has two fastening dowels 10 and 10' which can be anchored to the back side of the front panel 5. It can also be seen that the recess 6 is designed open to the frontal end wall of the wooden drawer side wall 2, and the recess 6 has a wall area 6*a* on its perimeter edge (i.e., a peripheral wall) which is essentially closed. The closed peripheral wall area 6*a* can also serve as bearing surface for a fastening device for fixing the receiving part 9 in the recess 6.

Figure 3:
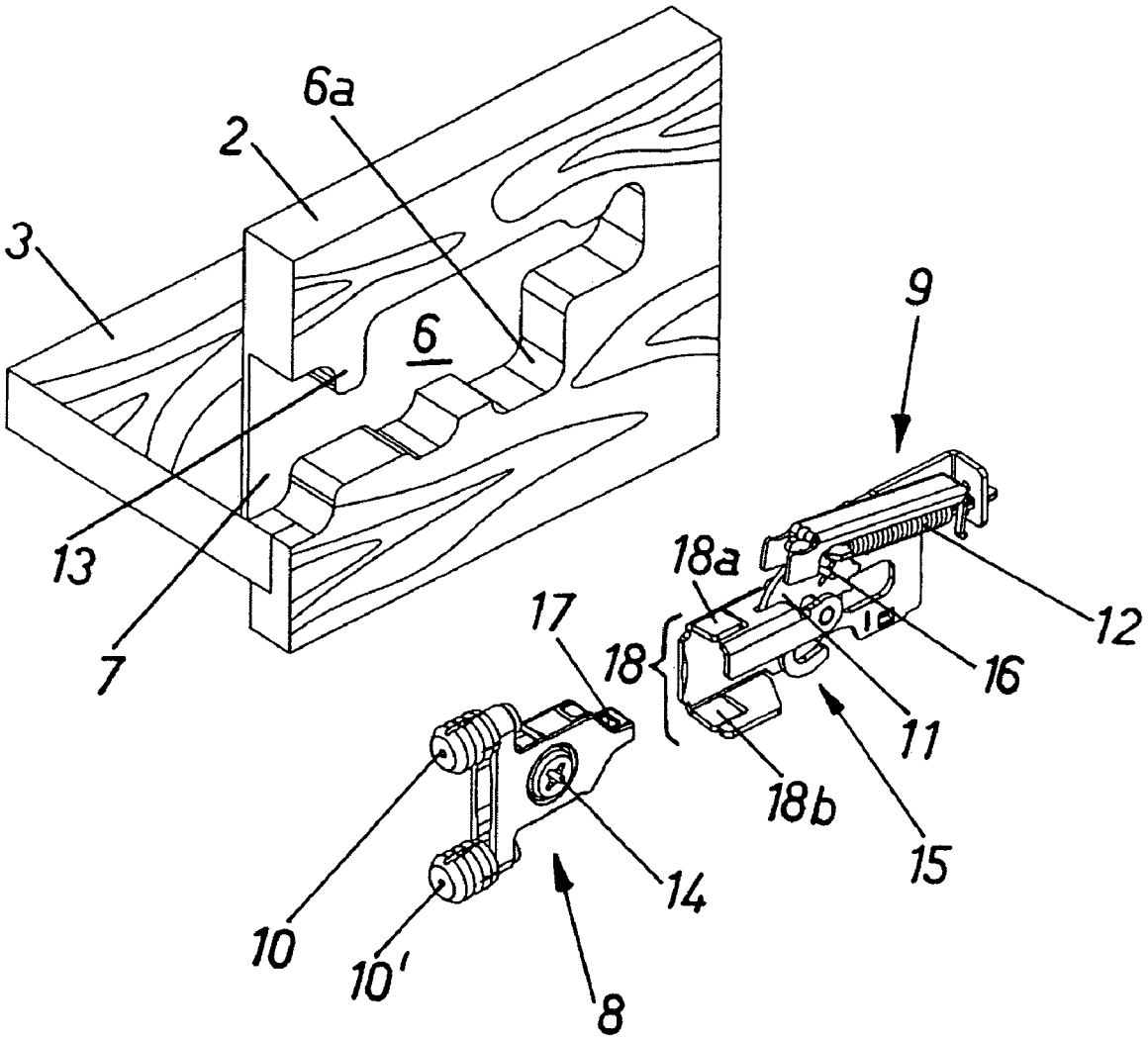

FIG. 3 shows an exploded view of the components used. At least one of the two side walls (panels) 2, 2' of the drawer 1 is made of solid wood, while in its front end area there is a recess 6, preferably milled out, having a closed interior base side wall 7. The contour (peripheral wall) of the recess 6 is essentially adapted to the shape of the receiving part 9, while advantageously a projection 13 is formed (in the peripheral wall) which prevents any displacement of the receiving part 9 inserted and locked in the recess 6 in the direction of extension of the drawer 1. The receiving part 9 comprises a fastening device 18 for a preferably detachable connection of the receiving part 9 with the recess 6. The fastening device 18 provides a preferably friction locked connection of the receiving part 9 with the recess 6 and includes, for example, two bendable tabs 18*a* and 18*b*, which can be brought to support on (bear against) the wall area (peripheral wall) 6*a* of the recess 6. Furthermore, the receiving part 9 includes a latch device 15 with a catch part 11, which is provided for detachable connection with a retaining element 8 mounted to the front panel 5. The catch part 11 is in the form of a rocking lever, and can lock into an opening 17 on the retaining element 8 due to the force exerted by the spring 12. There is also a lateral receiving portion 16 formed on the catch part 11 for a tool, preferably a cross-head screwdriver, so that the catch part 11 releases the retaining element 8 by clockwise rotation of the screwdriver. The retaining element 8 is pre-mountable on the back side of the front panel 5 by means of the fastening dowels 10 and 10', and also has a lateral adjustment screw 14 which is easy to access. The function of the receiving part 9 and of the retaining element 8 is not explained in more detail, since these devices and their co-operation are described in EP 0 740 917 B1.

Figures 4A, 4B, 4C:
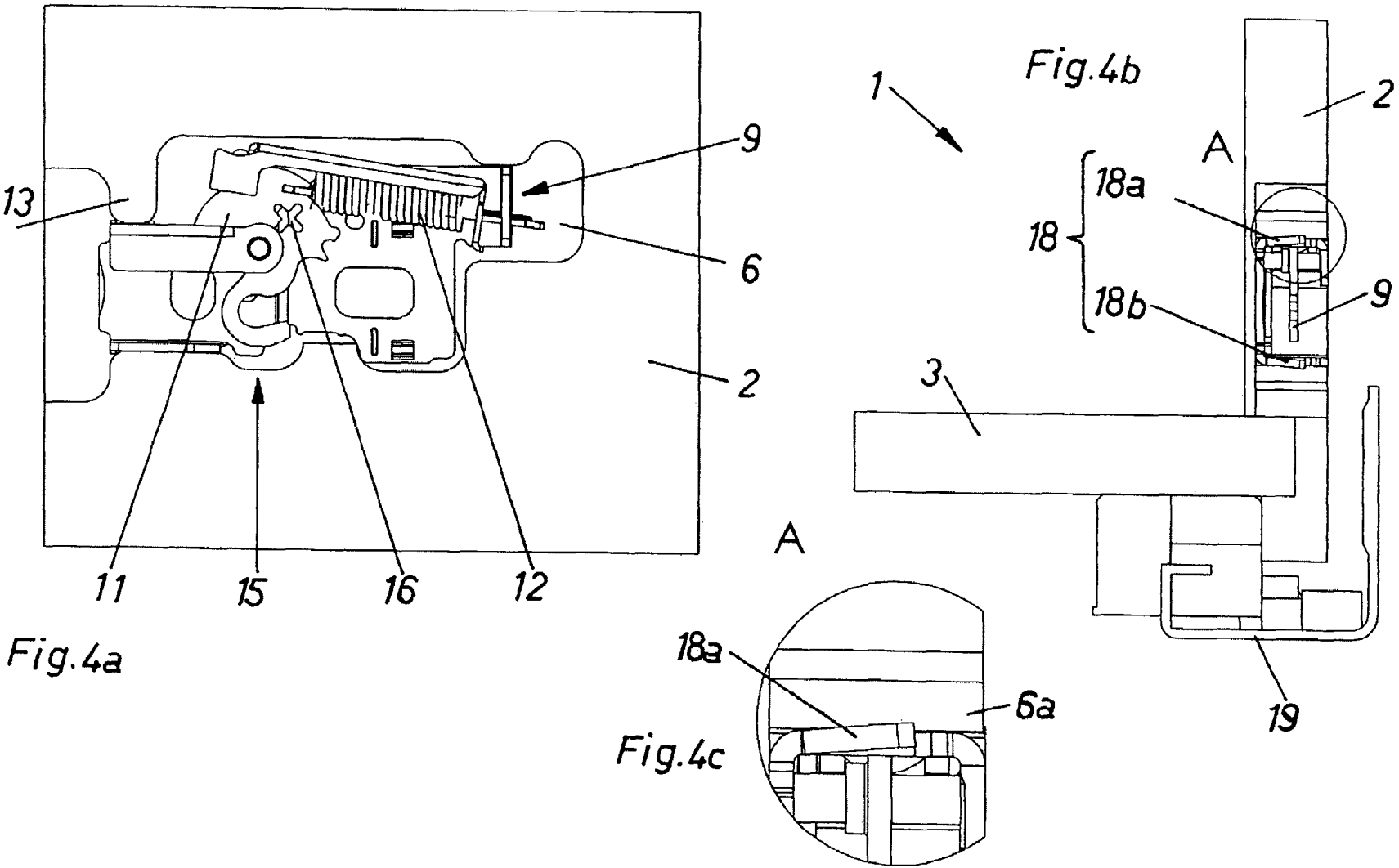

FIGS. 4*a*-4*c* show the receiving part 9 inserted in the recess 6 of the lateral drawer side wall 2. FIG. 4*a* shows a side view, FIG. 4*b* shows a cross-section of the drawer 1 from the front, and FIG. 4*c* shows the enlarged detail view A from FIG. 4*b*. The latch device 15 with the catch part 11 and the pressure-exerting spring 12 can be seen from FIG. 4*a*. To release the locking position, the cross recession (lateral receiving portion) 16 for a cross-head screwdriver is provided. From FIG. 4*b*, the fastening device 18 for preferably detachable fastening of the receiving part 9 in the recess 6 can be seen. The fastening device 18 preferably includes two bendable tabs 18*a* and 18*b*, which fix the receiving part 9 in the recess 6.

Also visible is a rail system 19, by means of which the drawer 1 travels relative to a body of furniture.

Figure 5B:
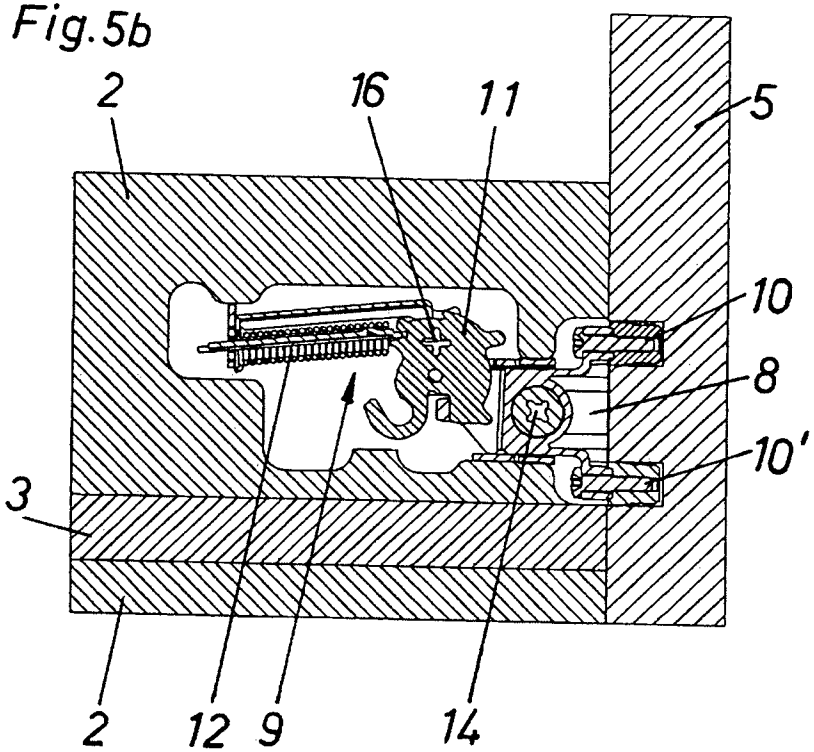
Figure 5A:
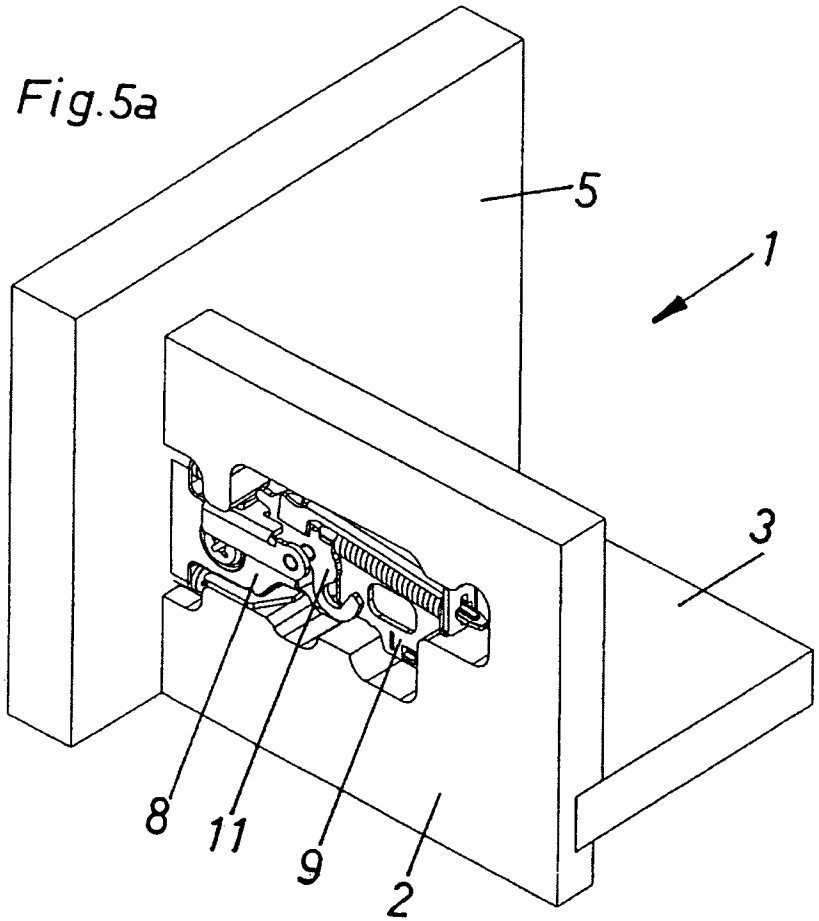

FIG. 5*a* shows a perspective rear view of the drawer 1 with mounted front panel 5, while FIG. 5*b* shows a sectional side view of the drawer 1. The receiving part 9 inserted in the recess 6 is solidly locked via the catch part 11 with the retaining element 8 pre-mounted on the front panel 5. It can be seen from FIG. 5*b* that the fastening dowels 10 and 10' of the retaining element 8 are solidly connected with the back side of the front panel 5.

Figure 6B:
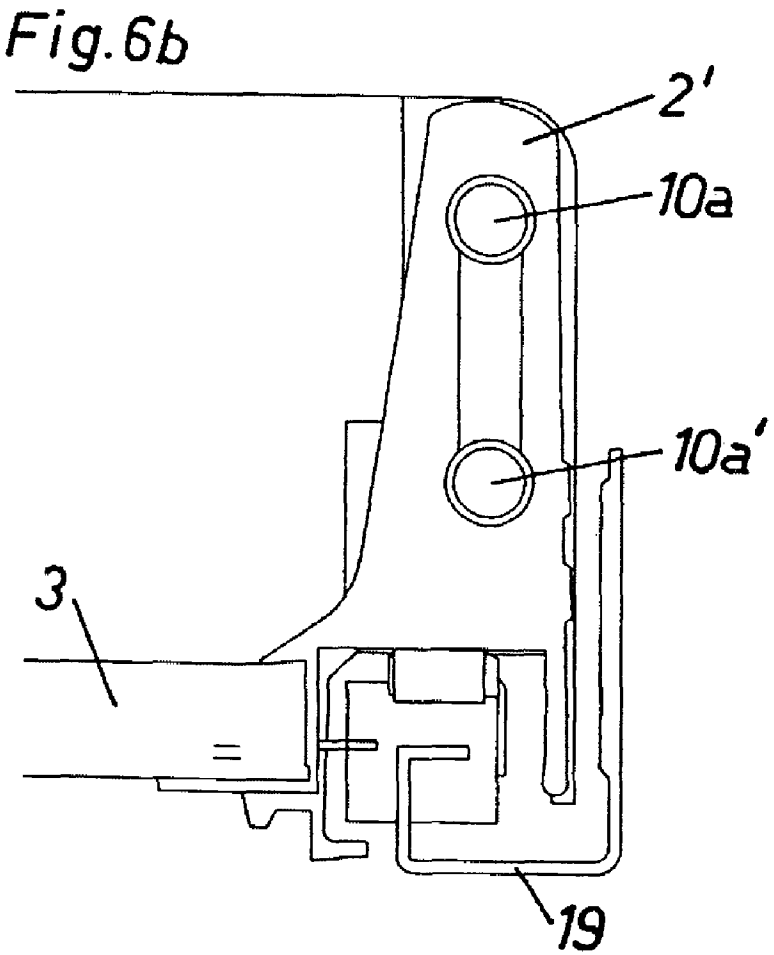
Figure 6A:
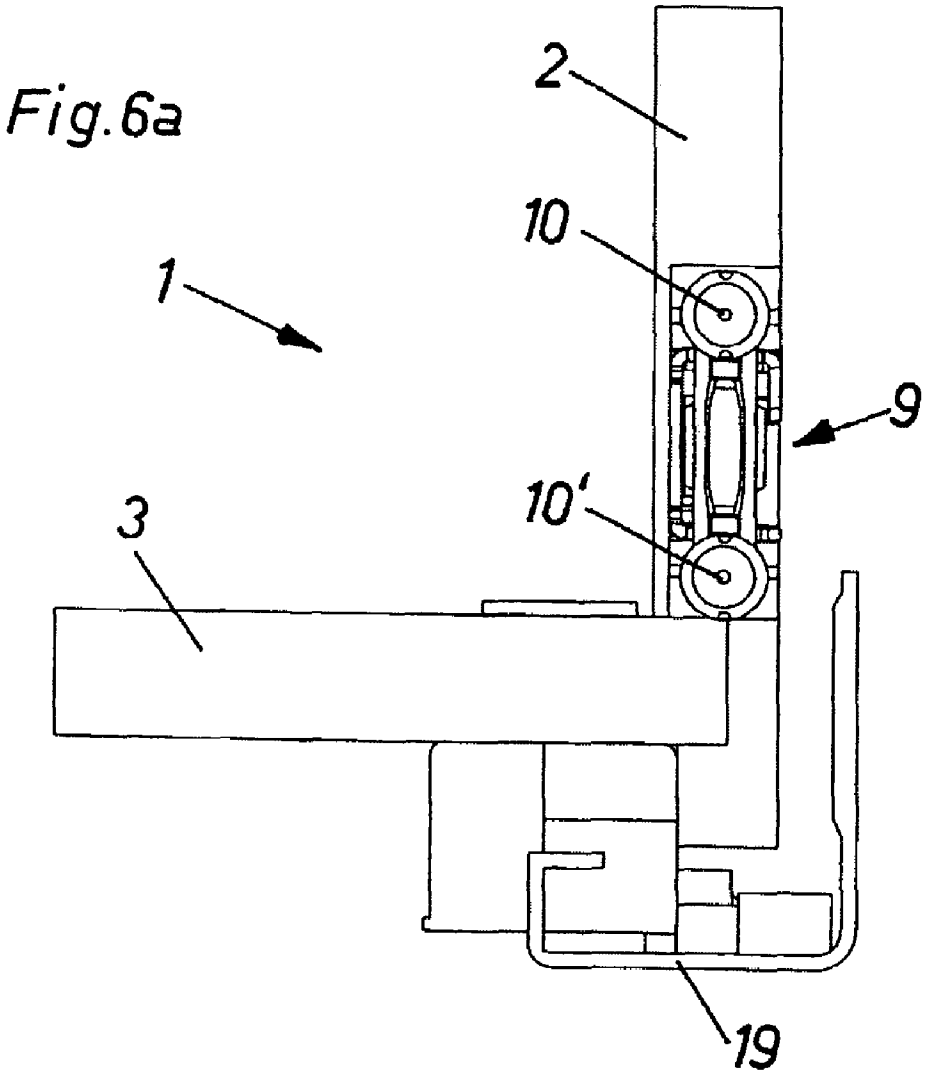

FIG. 6*a* and FIG. 6*b* show a particular advantage of the invention. FIG. 6*a* shows a sectioned front view of the drawer 1, in which the receiving part 9 is arranged inside the drawer side wall 2. FIG. 6*b* shows a similar view of a conventional double-walled hollow frame system 2', which also has fastening dowels 10 and 10' for fixing to a front panel 5. Thus, the same front mounting with its retaining element 8 can be used as with a hollow frame system 2'. The recess 6 of the drawer 1 is thereby arranged in such a way that the position of the receiving part 9 on the wooden drawer side wall 2 matches that of the hollow frame system 2' in common use. Thus the front mountings can be designed identically with the retaining elements 8 in wooden drawers and hollow frame systems, which brings with it considerable advantages in the production process.

The present invention is not limited to the embodiments shown, but covers and extends to all technical equivalents which may fall within the scope of the following claims. The positional details selected in the description, such as e.g. above, below, lateral, etc., relate to the figure just described and shown and if there is any change in position, this change should be analogously transferred to the new position. Also, the fastening device 18 shown in the figures, with the two tabs 18*a* and 18*b*, is only to be seen as an explanatory embodiment, whereby the person skilled in the art may orientate himself, but can also discover additional design variants in addition thereto.

The invention claimed is:

1. A drawer comprising:

a wooden side panel having a recess, said recess being shaped so as to have a peripheral wall and one of a closed exterior base side wall and a closed interior base side wall; and a receiving part for detachably fastening a front panel to said wooden side panel, said receiving part being arranged in said recess in said wooden side panel, said receiving part including:

a fastening device bearing against said peripheral wall of said recess for detachably retaining said receiving part within said recess of said wooden side panel; and a latch device for detachably attaching said receiving part to the front panel, said latch device including a catch part and a spring acting on said catch part so as to bias said catch part toward a catch position;

wherein said peripheral wall of said recess has a projecting portion extending into an interior of said recess, said projecting portion of said peripheral wall being shaped and arranged to engage said receiving part and thereby prevent displacement of said receiving part within said recess toward a front end of said drawer; and wherein said fastening device has a tab pressing against said projecting portion of said peripheral wall of said recess.

2. The drawer of claim 1, wherein said recess is located at a front end of said wooden side panel.

3. The drawer of claim 1, wherein said recess is shaped so as to be open at a front end of said wooden side panel.

4. The drawer of claim 1, wherein said peripheral wall of said recess is closed.

5. The drawer of claim 1, wherein said peripheral wall of said recess has a shape corresponding to an outer contour of said receiving part.

6. The drawer of claim 1, wherein said recess is shaped such that said receiving part is inserted into said recess of said wooden side panel from a side of said wooden side panel.

7. The drawer of claim 1, wherein said base side wall of said recess and said wooden side panel have a one-piece construction and are formed from a single unitary piece of wood.

8. The drawer of claim 1, wherein said recess is milled out of said wooden side panel.

9. The drawer of claim 1, wherein said peripheral wall of said recess has a frontal end portion, said receiving part being arranged to lie completely behind said frontal end portion of said peripheral wall of said recess, and to lie inside said exterior base side wall or said interior base side wall of said recess.

10. The drawer of claim 1, wherein said tab is resilient, spring-loaded or bendable.

11. The drawer of claim 1, wherein said tab is one of a pair of flat tabs located at respective opposite sides of said fastening device, said pair of flat tabs being bendable so as to be positioned to bear against opposite sides of said peripheral wall of said recess so as to retain said receiving part within said recess.

12. The drawer of claim 1, further comprising a front panel and a retaining element mounted to said front panel, said receiving part being releasably connected to said retaining element via said latch device to thereby detachably fasten said front panel to said wooden side panel.

13. The drawer of claim 12, wherein said retaining element projects outwardly from a back side of said front panel towards said wooden side panel.

14. The drawer of claim 12, wherein said catch part comprises a rocking lever for engaging and detachably attaching to said retaining element due to a spring force applied by said spring.

15. The drawer of claim 1, wherein said catch part has a lateral receiving portion for receiving a tool, said lateral receiving portion being operable to move said catch part away from the catch position to thereby release the front panel when manipulated by the tool.

16. The drawer of claim 1, wherein said fastening device is shaped and arranged to retain said receiving part in said recess by one of friction-locking and positive-holding.

* * * * *